US010661281B2

(12) United States Patent
Kaplan

(10) Patent No.: US 10,661,281 B2
(45) Date of Patent: May 26, 2020

(54) LIGHTER CASE WITH PISTON DISPENSER

(71) Applicant: BurnBud, LLC, Tucson, AZ (US)

(72) Inventor: Jonathan Kaplan, Tucson, AZ (US)

(73) Assignee: BURNBUD, LLC, Tucson, AZ (US)

( * ) Notice: Subject to any disclaimer, the term of this patent is extended or adjusted under 35 U.S.C. 154(b) by 449 days.

(21) Appl. No.: 15/436,504

(22) Filed: Feb. 17, 2017

(65) Prior Publication Data

US 2017/0241642 A1 Aug. 24, 2017

Related U.S. Application Data

(60) Provisional application No. 62/297,244, filed on Feb. 19, 2016.

(51) Int. Cl.

| | |
|---|---|
| ***B02C 19/20*** | (2006.01) |
| ***A24B 7/00*** | (2006.01) |
| ***A24F 9/16*** | (2006.01) |
| ***A24F 17/00*** | (2006.01) |
| ***A24F 23/00*** | (2006.01) |
| ***F23Q 2/50*** | (2006.01) |
| ***B67B 7/44*** | (2006.01) |
| ***F23Q 2/38*** | (2006.01) |

(52) U.S. Cl.

CPC ..... *B02C 19/20* (2013.01); *A24B 7/00* (2013.01); *A24F 9/16* (2013.01); *A24F 17/00* (2013.01); *A24F 23/00* (2013.01); *B67B 7/44* (2013.01); *F23Q 2/38* (2013.01); *F23Q 2/50* (2013.01)

(58) Field of Classification Search

CPC . B02C 19/20; A24B 7/00; A24F 17/00; F23Q 2/38

See application file for complete search history.

(56) References Cited

U.S. PATENT DOCUMENTS

| | | | | |
|---|---|---|---|---|
| 6,532,837 | B1 * | 3/2003 | Magussen, Jr. ..... | B01L 3/0279 73/864.01 |
| D669,746 | S | 10/2012 | Scharf et al. | |
| D669,747 | S | 10/2012 | Scharf et al. | |
| 8,636,237 | B2 | 1/2014 | Scharf et al. | |
| 8,672,249 | B2 | 3/2014 | Scharf et al. | |
| 8,882,010 | B2 | 11/2014 | Scharf et al. | |
| 2007/0048681 | A1 * | 3/2007 | Wong ..... | F23O 2/164 431/153 |
| 2010/0136494 | A1 * | 6/2010 | Connolly ..... | A24F 17/00 431/253 |

(Continued)

FOREIGN PATENT DOCUMENTS

| | | | |
|---|---|---|---|
| AU | 2011355672 | A1 | 9/2013 |
| CA | 2825150 | A1 | 7/2012 |

(Continued)

*Primary Examiner* — Ibrahime A Abraham
*Assistant Examiner* — Ahmad Abdel-Rahman
(74) *Attorney, Agent, or Firm* — Foley & Lardner LLP

(57) ABSTRACT

A lighter case is provided. The lighter case may have a main body forming a clamshell shaped to receive a cigarette lighter. The lighter case may have a grinding apparatus on a portion of the main body or slidable relative to the main body and configured to disaggregate a smoking material. The lighter case may collect the disaggregated smoking material and may guide the disaggregated smoking material into a receptacle such as by scooping or via a piston. In this manner, the smoking material may be prepared.

1 Claim, 16 Drawing Sheets

(56) References Cited

U.S. PATENT DOCUMENTS

| | | | | |
|---|---|---|---|---|
| 2013/0160778 | A1* | 6/2013 | Magnone | F23Q 2/32 131/328 |
| 2013/0214074 | A1 | 8/2013 | Scharf et al. | |
| 2013/0220848 | A1* | 8/2013 | Scharf | B65D 85/70 206/216 |
| 2014/0035508 | A1* | 2/2014 | Wilson | H02J 7/0042 320/101 |
| 2015/0226432 | A1* | 8/2015 | Borschke | F23O 2/345 431/253 |
| 2016/0106262 | A1* | 4/2016 | Mroue | A47J 42/26 241/79 |
| 2017/0000247 | A1 | 1/2017 | Scharf et al. | |
| 2017/0135398 | A1* | 5/2017 | Scott | A24F 47/002 |
| 2018/0360108 | A1* | 12/2018 | King, Jr. | A24F 13/26 |

FOREIGN PATENT DOCUMENTS

| | | | |
|---|---|---|---|
| CN | 202064356 | U | 12/2011 |
| CN | 203061251 | U | 7/2013 |
| CN | 203454203 | U | 2/2014 |
| EP | 2667754 | A2 | 12/2013 |
| WO | WO-2012099646 | A2 | 7/2012 |
| WO | WO-2014100773 | A1 | 6/2014 |

* cited by examiner

LIGHTER CASE WITH PISTON DISPENSER

CROSS-REFERENCE TO RELATED APPLICATIONS

Pursuant to 35 U.S.C. § 119(e), this application claims the benefit of, and hereby incorporates by reference for all purposes, U.S. Provisional Patent Application Ser. No. 62/297,244 entitled "Lighter Case with Piston Dispenser," filed Feb. 19, 2016.

FIELD OF INVENTION

The present disclosure relates to a lighter case, and more particularly, a lighter case comprising various mechanisms for the preparation of smoking products, including a piston dispensing system for dispensing smoking material.

BACKGROUND OF INVENTION

Portable lighters are frequently carried conveniently on one's person to ignite smoking materials, such as for use with rolled smoking systems, such as cigarettes, or with pipes, or with water pipes such as hookas and the like. Frequently, loose smoking products are desired to be prepared. The preparation of loose smoking products often involves the use of various tools. However, such tools are prone to being lost and are inconvenient to carry.

SUMMARY OF THE INVENTION

A multifunction lighter case is disclosed. The multifunction lighter case may include a main body configured to receive a lighter, and a grinding apparatus having an integral surface of the main body configured to disaggregate a smoking material.

A clamshell multifunction lighter case is provided that may include a main body having a first clamshell portion and a second clamshell portion joined by a hinge, and a grinding apparatus including an integral surface of the main body configured to disaggregate a smoking material. The clamshell multifunction lighter case may also have a ramp member attached to the main body and having a shaped flange having a channel configured to guide disaggregated smoking material into a receptacle.

A method of smoking material preparation is disclosed. The method may include grinding a smoking material against a grinding apparatus of a clamshell multifunction lighter case, collecting a disaggregated smoking material in an internal area of the lighter case, and guiding by a ramp member of the lighter case the disaggregated smoking material into a receptacle.

A method of smoking material preparation is provided that may include grinding a smoking material against a grinding apparatus of a multifunction lighter case, and collecting a disaggregated smoking material atop an underlying surface as it falls from a ground material cavity of the multifunction lighter case.

A multifunction lighter case is disclosed. The multifunction lighter case may include a main body forming a partial enclosure configured to receive a lighter at least partially inside the main body of the multifunction lighter case, and a grinding apparatus including at least one of an integral surface of the main body and a slidable sheet, wherein the grinding apparatus is configured to disaggregate a smoking material.

In various embodiments of the multifunction lighter case the main body is a unitary body structure. In various embodiments of the multifunction lighter case, the main body is a clamshell selectably openable about a hinge. In various embodiments of the multifunction lighter case includes a bottle opener. The bottle opener may include a curved cutaway portion disposed in a side of the main body of the multifunction lighter case and configured to receive a crimp-top of a bottle and a sharp edge engagable with the crimp top and configured to permit a user to remove the crimp-top in response to an arcuate articulation of the multifunction lighter case. In various embodiments, the multifunction lighter case includes a ground smoking material storage compartment configured to receive the ground smoking material from the grinding apparatus. In various embodiments, the grinding apparatus includes the slidable sheet and the slidable sheet is insertable into a portion of the main body. In various embodiments, the slidable sheet includes a blocking portion slidable over an opening of the ground smoking material storage compartment, and a first aperture set defined through the slidable sheet and adjacent the blocking portion, wherein the first aperture set and the blocking portion is each alternately slidable over the opening of the ground smoking material storage compartment.

In various embodiments, the multifunction lighter case has a grippable member grippable by a user to slide the slidable sheet.

In various embodiments of the multifunction lighter case has a piston dispensing system. The piston dispensing system may have a transfer aperture connecting a ground smoking material storage compartment to a piston channel, a piston configured to slidably reciprocate within the piston channel and alternately occupy and vacate a portion of the piston channel coincident with the transfer channel, and an extrusion orifice disposed at a distal end of the piston channel and configured to receive a compressed smoking material compressed by the piston and expel the compressed smoking material. The piston dispensing system may also have a spring wrapped around a spring guide and configured to react a spring force against a spring platform, a reciprocal piston clip formed in the piston, and a spring loaded transfer clip pressed by the spring against the reciprocal piston clip formed in the piston. The piston dispensing system further may have a piston latch button configured to permit a latch channel to align so that the piston is reciprocally slidable within the piston channel, and a piston lock including a piston lock bar slidable away from the piston and away from the reciprocal piston clip, whereby the piston is removable from the piston channel.

In various embodiments, the multifunction lighter case may have a rolling paper dispenser. The rolling paper dispenser may have a rolling paper storage area and a rolling paper door closable over the rolling paper storage area. In various embodiments, the multifunction lighter case has a keif collector including a kief storage door having a plurality of holes to grind an herb, and a kief storage area enclosed by the keif storage door. In various embodiments, the multifunction lighter case has a clamp configured to selectable mount the multifunction lighter case to a water pipe. In various embodiments of the multifunction lighter case has a pipe storage fixture forming a cavity to receive a pipe, wherein the pipe storage fixture is aligned parallel to a primary longitudinal axis of the multifunction lighter case and connectable to the multifunction lighter case by a mounting member, wherein the mounting member has a structure extending laterally away from the multifunction lighter case and joining the multifunction lighter case in permanent fixity to the pipe storage fixture.

In various embodiments of the multifunction lighter case has an electric lighter. The electric lighter may have a heatable coil, a power source, and an on/off switch configured to selectably connect the power source to the heatable coil.

In various embodiments, the multifunction lighter case has a herb blender configured to blend a plurality of smoking materials. The herb blender may have a motor, a blending blade rotatable by the motor, and a power source powering the motor.

In various embodiments, the multifunction lighter case has a lighter safety remover, the lighter safety remover including a groove defined into the sharp edge, wherein the groove penetrates a shorter face of the sharp edge, and wherein the groove is configured to lift a lighter safety away from a lighter in response to arcuate articulation of the multifunction lighter case.

In various embodiments, the multifunction lighter case has a lighter wick dispenser. The lighter wick dispenser may have an aperture disposed in a surface of the multifunction lighter case through which a wick may be drawn and a wick wheel having a rotatable cylinder on which the wick is stored.

A clamshell multifunction lighter case is disclosed. The clamshell multifunction lighter case may include a main body having a first clamshell portion and a second clamshell portion joined by a hinge, a grinding apparatus including an integral surface of the main body configured to disaggregate a smoking material, and a ramp member attached to the main body and having a shaped flange having a channel configured to guide disaggregated smoking material into a receptacle.

A method of manufacturing a multifunction lighter case is disclosed. The method may include providing a main body having a unitary body structure forming a partial enclosure configured to receive a lighter at least partially inside the main body of the multifunction lighter case. The method may include providing a grinding apparatus including an integral surface of a slidable sheet, wherein the grinding apparatus is configured to disaggregate a smoking material. The method may include providing a bottle opener, the bottle opener having a curved cutaway portion disposed in a side of the main body of the multifunction lighter case and configured to receive a crimp-top of a bottle and also having a sharp edge engagable with the crimp top and configured to permit a user to remove the crimp-top in response to an arcuate articulation of the multifunction lighter case. The method may include providing a ground smoking material storage compartment configured to receive the ground smoking material from the grinding apparatus. In various embodiments the grinding apparatus includes the slidable sheet and the slidable sheet is insertable into a portion of the main body. In various embodiments the slidable sheet includes a blocking portion slidable over an opening of the ground smoking material storage compartment, and a first aperture set defined through the slidable sheet and adjacent the blocking portion. In various embodiments, the first aperture set and the blocking portion is each alternately slidable over the opening of the ground smoking material storage compartment. The method may include providing a piston dispensing system, the piston dispensing system having a transfer aperture connecting a ground smoking material storage compartment to a piston channel, a piston configured to slidably reciprocate within the piston channel and alternately occupy and vacate a portion of the piston channel coincident with the transfer channel, and an extrusion orifice disposed at a distal end of the piston channel and configured to receive a compressed smoking material compressed by the piston and expel the compressed smoking material. The piston dispensing system may also include a spring wrapped around a spring guide and configured to react a spring force against a spring platform, a reciprocal piston clip formed in the piston, a spring loaded transfer clip pressed by the spring against the reciprocal piston clip formed in the piston, a piston latch button configured to permit a latch channel to align so that the piston is reciprocally slidable within the piston channel, and a piston lock having a piston lock bar slidable away from the piston and away from the reciprocal piston clip, whereby the piston is removable from the piston channel.

Thus, as one may appreciate, in various embodiments, the device and method may grind, store, and dispense a smoking material into a container for smoking, may fit in a user's pocket, and may grind directly into a smoking container, and/or a storage portion of the multifunction lighter case for later dispensing and smoking.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1A:
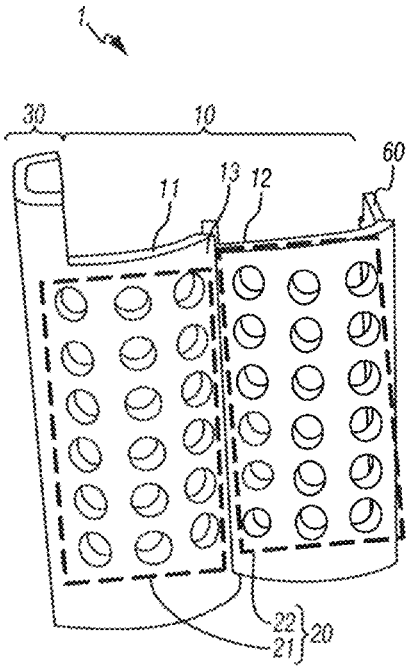
FIGS. 1A-B illustrate views of an example clamshell multifunction lighter case in an open configuration according to various embodiments.

The detailed description herein makes use of various exemplary embodiments to assist in disclosing the present invention. While these exemplary embodiments are described in sufficient detail to enable those skilled in the art to practice the invention, it should be understood that other embodiments may be realized and that modifications of structures, arrangements, applications, proportions, elements, materials, or components used in the practice of the instant invention, in addition to those not specifically recited, can be varied or otherwise particularly adapted to specific environments, manufacturing specifications, design parameters or other operating requirements without departing from the scope of the present invention and are intended to be included in this disclosure. Thus, the detailed description herein is presented for purposes of illustration only and not of limitation.

For the sake of brevity, conventional techniques for manufacturing and construction may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

As used herein, phrases such as "make contact with," "coupled to," "touch," "interface with" and "engage" may be used interchangeably. As used herein, to be connected in "fluid communication" or "fluidic communication" or to be in "fluidic interconnection" means that a passage exists between the connected elements via which a fluid, including a gas and/or a liquid and/or any other non-solid matter, may pass from one connected element to another connected element.

As used herein, smoking material includes but is not limited to tobacco, biological matter, plant matter, herbs, and/or the like.

With reference to FIGS. 1A-B and 2A-C, a clamshell multifunction lighter case 1 may comprise a case configured to receive a portable lighter. The clamshell multifunction lighter case 1 may form a clamshell about the lighter wherein the lighter may be disposed at least partially inside the clamshell. In this manner, the clamshell multifunction lighter case 1 may provide protection to the lighter and may be conveniently co-located with the lighter, such as for carrying and storage.

The clamshell multifunction lighter case 1 may comprise a main body 10. The main body 10 may comprise a clamshell structure of the clamshell multifunction lighter case 1. The main body 10 may comprise one or more arcuate flanges joined by a hinge 13.

The main body 10 may comprise a first clamshell portion 11 and a second clamshell portion 12 joined by a hinge 13.

The first clamshell portion 11 and the second clamshell portion 12 may each comprise a shape corresponding to a profile of a lighter. In various embodiments, both the first clamshell portion 11 and the second clamshell portion 12 comprise arcuate flanges joined by a hinge 13 extending along corresponding ends of the first clamshell portion 11 and the second clamshell portion 12, respectively. For instance, the hinge 13 may run lengthwise along the first clamshell portion 11 and the second clamshell portion 12 parallel to a primary lengthwise axis of a lighter.

The hinge 13 may comprise one or more corresponding pins and sockets, or may comprise a plurality of sockets joined by a shared pin. In further embodiments, the hinge 13 may be integrally formed with both the first clamshell portion 11 and the second clamshell portion 12. For example, the first clamshell portion 11 and the second clamshell portion 12 may be formed from a single piece of bendable material. The hinge 13 may comprise a localized thinning, scoring, flexibility gradient, and/or the like, whereby the first clamshell portion 11 and the second clamshell portion 12 are angularly articulable about an axis of the hinge 13.

In various embodiments, the clamshell multifunction lighter case 1 may further comprise a grinding apparatus 20. A grinding apparatus 20 may comprise an integrally formed surface and/or portion of the main body 10. For instance, the grinding apparatus 20 may comprise an integrally formed portion of a first clamshell portion 11 and/or a second clamshell portion 12. In further embodiments, the grinding apparatus 20 may comprise a separately formed insert of the main body 10. For instance, the grinding apparatus 20 may comprise an insert shaped to fit a corresponding aperture of a first clamshell portion 11 and/or a second clamshell portion 12.

The grinding apparatus 20 may grind a smoking material. For instance, a user may place a smoking material against the grinding apparatus 20 and at least one of, move, press, slide, and/or otherwise contact the smoking material against the grinding apparatus 20, mechanically separating the smoking material and/or otherwise preparing the smoking material such as for ignition, heating, and/or the like. The grinding apparatus 20 may comprise a set of apertures. The apertures may be disposed through a portion of the clamshell multifunction lighter case 1. As the smoking material is manipulated against the apertures, the smoking material may disaggregate and collect on the opposite side of the apertures.

Figure 1B:
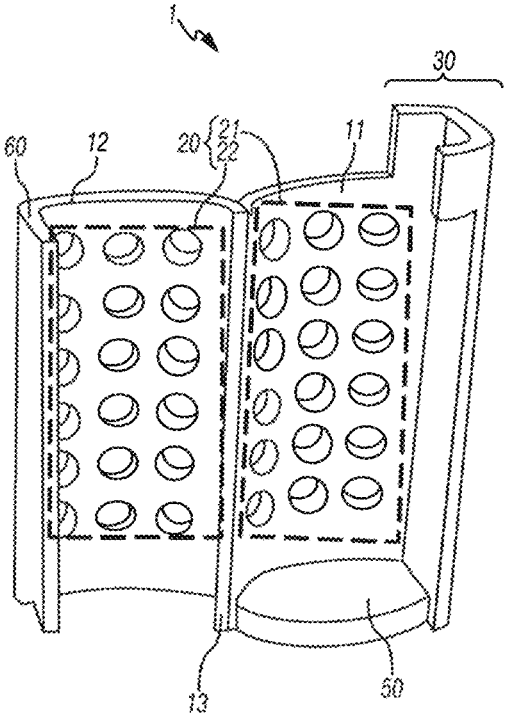
Figure 2A:
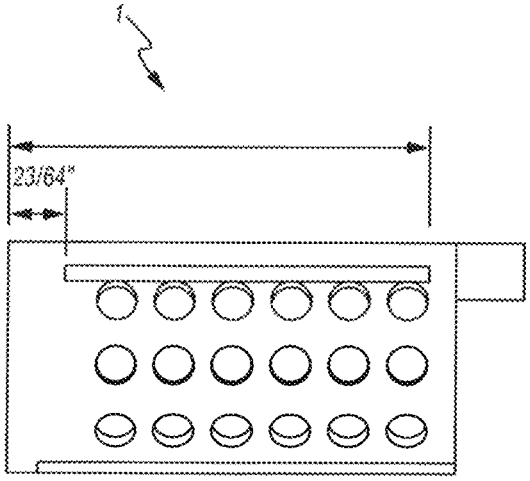
FIGS. 2A-C illustrate views of an example clamshell multifunction lighter case in a closed configuration according to various embodiments.
Figure 2B:
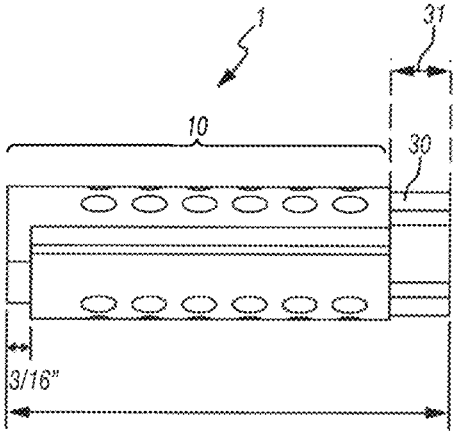
Figure 2C:
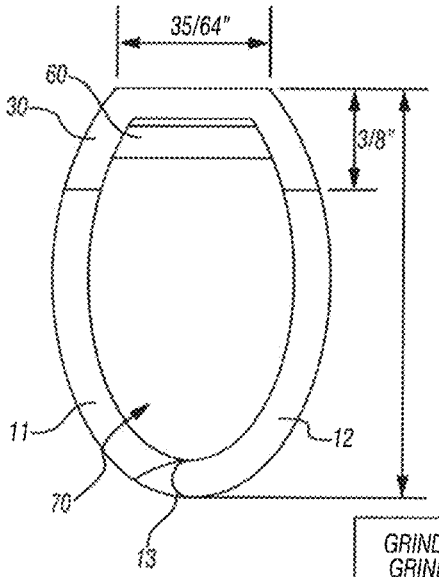
Figure 3A:
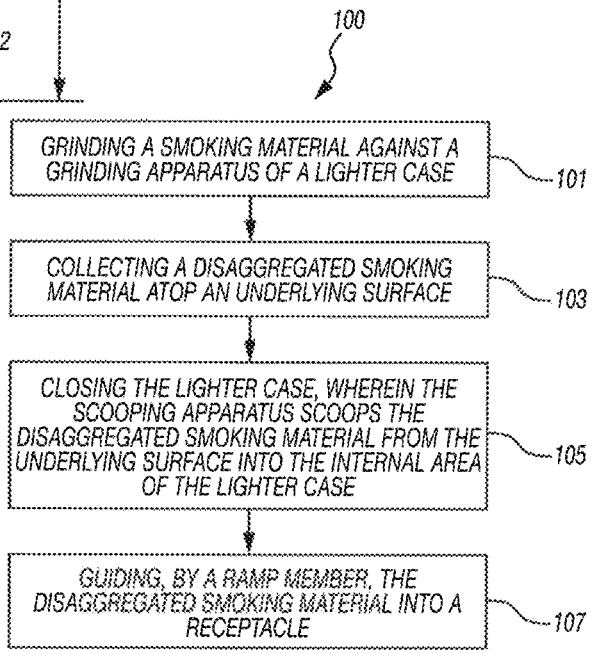
FIGS. 3A-B illustrate methods of smoking material preparation according to various embodiments of a clamshell multifunction lighter case.
Figure 3B:
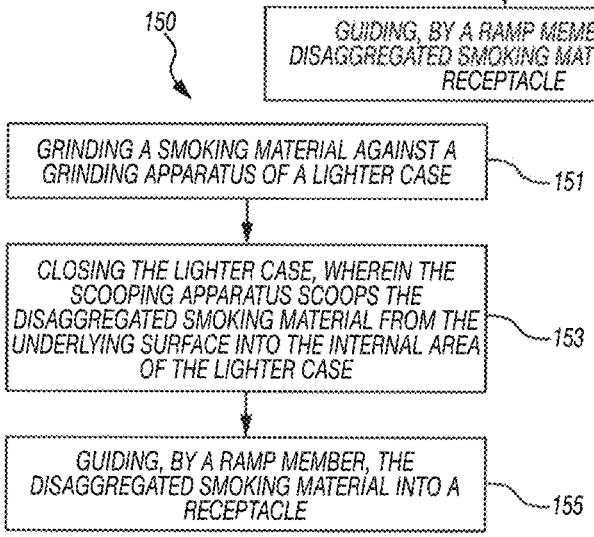

For example, a grinding apparatus 20 may comprise a first aperture set 21 and a second aperture set 22. The first aperture set 21 may be defined through the first clamshell portion 11 of the main body 10 and the second aperture set 22 may be defined through the second clamshell portion 12 of the main body 10. Smoking material may be manipulated against the apertures causing the smoking material to disaggregate and collect inside the main body 10. In further materials, the main body 10 may be positioned in an open position as illustrated in FIGS. 1A-B during the manipulation, so that the smoking material falls through the main body 10 and collects on an underlying surface. Subsequently the first clamshell portion 11 and the second clamshell portion 12 may be brought toward each other about the hinge 13 and the main body 10 may be positioned in a closed position as illustrated in FIGS. 2A-C, so that the smoking material is scooped by the scooping apparatus 60 (and/or the floor member 50) into the internal area 70 of the main body 10.

The clamshell multifunction lighter case 1 may comprise a ramp member 30. A ramp member 30 may comprise a shaped flange having a channel configured to guide smoking material that has collected in the internal area 70 of the main body 10 in a neat manner toward an intended receptacle, such as into a bowl. The ramp member 30 may comprise an U-shaped flange, or a C-shaped flange, or a V-shaped flange or any flange having a channel as desired. With specific reference to FIG. 2B, the ramp member 30 may extend a first ramp distance 31 outward from the upper distal end (relative to the floor member 50 and/or the lighter) of the main body 10. In this manner, the ramp member 30 may provide a guiding path, similar to a trough, for smoking material being poured from a main body 10 in the closed position.

The clamshell multifunction lighter case 1 may further comprise a floor member 50. A floor member 50 may comprise a flange extending from at least one of the first clamshell portion 11 toward the second clamshell portion 12 or from the second clamshell portion 12 toward the first clamshell portion 11 so that as the main body 10 is positioned in the closed position, the floor member 50 comprises a surface upon which the lighter may rest when a lighter is disposed within the clamshell multifunction lighter case 1, such as for storage.

The clamshell multifunction lighter case 1 may further comprise a scooping apparatus 60. A scooping apparatus 60 may comprise a planar flange extending inwardly from one of the first clamshell portion 11 and/or the second clamshell portion 12. The scooping apparatus 60 may comprise a mechanism whereby disaggregated smoking material may be scooped into the internal area 70 as the main body 10 transitions from an open position to a closed position. In various embodiments, the scooping apparatus 60 further provides a rest to at least partially support the clamshell multifunction lighter case 1 and react mechanical loads exerted on the case by the pressing of smoking material against the grinding apparatus 20 during use.

Finally, the clamshell multifunction lighter case 1 may comprise an articulable tool. An articulable tool may comprise a hinged member selectably extendable from the clamshell multifunction lighter case 1. The articulable tool may comprise a bottle opener. Thus, the articulable tool may be selectably extended from the clamshell multifunction lighter case 1, the clamshell multifunction lighter case 1 may be oriented in a closed position, and the clamshell multifunction lighter case 1 may be used as a grip during the opening of a bottle by the bottle opener. In various embodiments, the articulable tool may further comprise a file, a knife, scissors, pliers, a screwdriver, a member to assist in the rolling of cigarette papers, and/or the like.

With reference now to FIGS. 4A-12B, a multifunction lighter case 201 may comprise a case configured to receive a portable lighter. The multifunction lighter case 201 may form a partial enclosure about the lighter wherein the lighter may be disposed at least partially inside the multifunction lighter case. In this manner, the multifunction lighter case 201 may provide protection to the lighter and may be conveniently co-located with the lighter, such as for carrying and storage. In various embodiments, the multifunction lighter case 201 may comprise a main body 210. The main body 210 may comprise a unitary body structure of the multifunction lighter case 201. The main body 210 may comprise a one-piece structure with various features, apertures, and the like, and may be configured to receive a lighter disposed at least partially inside the main body 210. Thus, one may appreciate that while a main body 10 (FIGS. 1A-2C) may be selectably openable about a hinge, a main body 210 may comprise a one-piece body that receives a lighter therein. In further embodiments, various features of various embodiments disclosed herein, such as features of main body 10 and main body 210 or more generally, features of multifunction lighter case 201 and clamshell multifunction lighter case 1 may be mixed and/or combined.

Figure 4A:
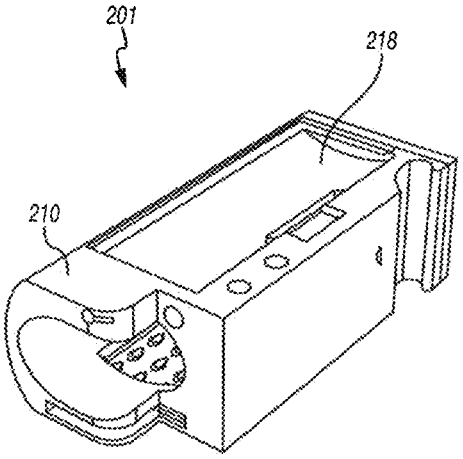
FIGS. 4A-B illustrate views of an example multifunction lighter case according to various embodiments.
Figure 4B:
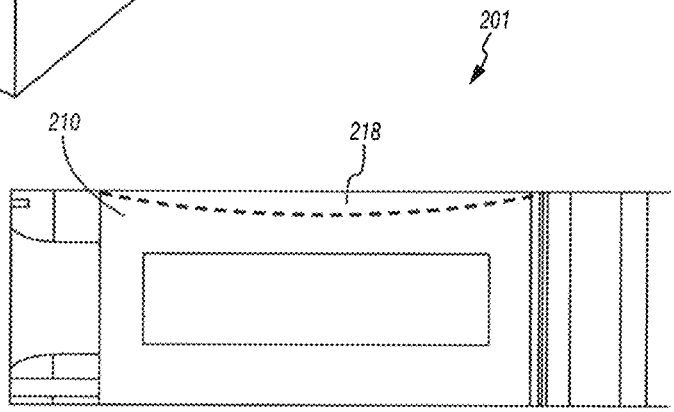

With reference to FIGS. 4A-B, in various embodiments, the multifunction lighter case 201 may comprise an ash bowl 218. An ash bowl 218 may comprise a depression formed in the surface of the exterior of the main body 210 of the multifunction lighter case 201. For instance, the ash bowl 218 may comprise a depression formed in a side of the main body 210 of the multifunction lighter case 201. As such, the multifunction lighter case 201 may be rested on its side, and a depression formed in an opposite side may provide a receptacle for the collection of ash and/or expended smoking product.

Figure 5A:
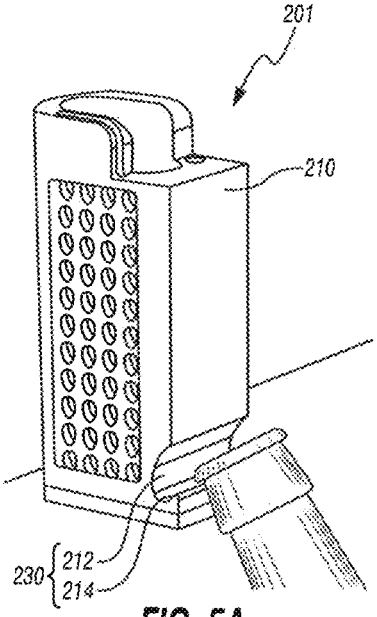
FIGS. 5A-B illustrate views of an example bottle opener of a multifunction lighter case, according to various embodiments.
Figure 5B:
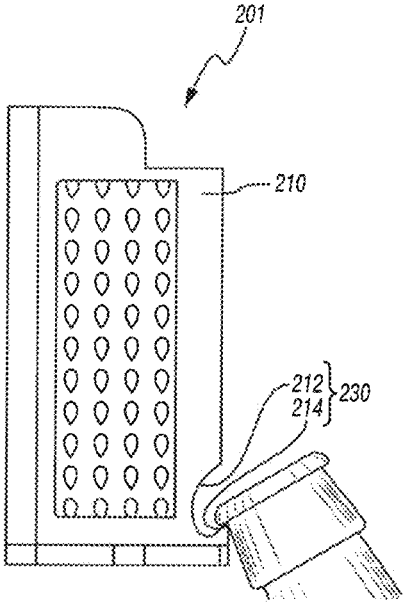
Figure 6C:
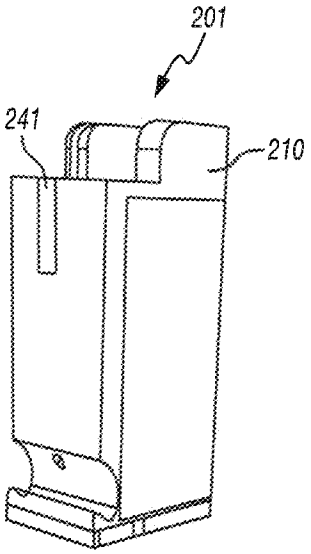
FIGS. 6A-C illustrate views of an example dab needle and dab needle channel of a multifunction lighter case, according to various embodiments.
Figure 6B:
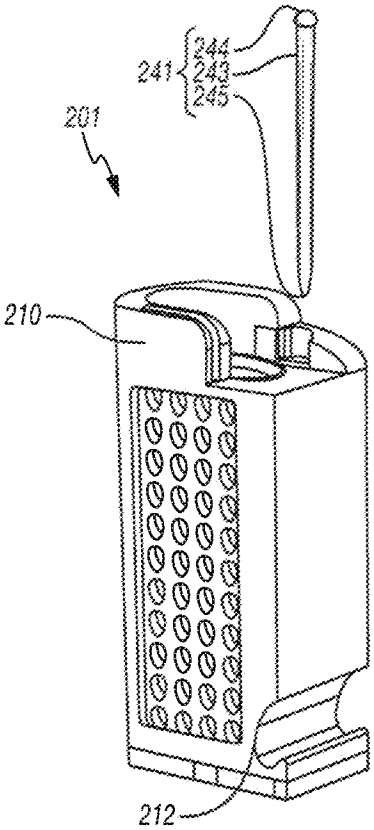
Figure 6A:
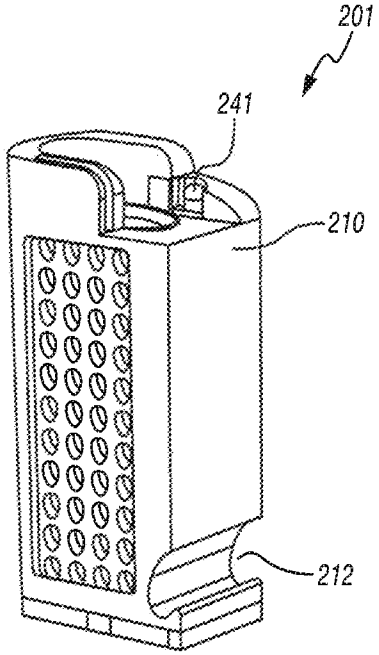

With reference to FIGS. 5A-B, in various embodiments, the multifunction lighter case 201 may comprise a bottle opener 230. For instance, a bottle opener 230 may comprise a curved cutaway portion 212 of a multifunction lighter case 201 disposed in a side of the multifunction lighter case 201 and configured to receive a crimp-top of a bottle and permit the crimp-top to be removed from the bottle, such as by a lever motion wherein the multifunction lighter case 201 is arcuately articulated about a fulcrum provided by at least one of the bottle and the crimp-top. The bottle opener 230 may further comprise a sharp edge 214 engagable with the crimp-top. In various embodiments, as discussed further herein, sharp edge 214 and curved cutaway portion 212 may perform other functions as well.

With reference to FIGS. 6A-C and 10, in various embodiments, the multifunction lighter case 201 may comprise a dab needle channel 241 configured to receive a dab needle 242. In various embodiments, a dab needle 242 may comprise a shaft 243 with a pressing tip 244 and a cutting tip 245. The pressing tip 244 may comprise a spheroid, or any other shape whereby the dab needle 242 may be conveniently held, or whereby distributed pressure may be exerted on a material. Moreover, the dab needle 242, and particularly, the pressing tip 244 may comprise a mechanism for conveyance of fluid, resin, resinous mixture and/or the like ("dabbing material"), such as by surface tension, and such as to convey a dabbing material to a heat source to release aromatic, medicinal, and/or other compounds as desired. While in various embodiments, such as with reference to FIGS. 6A, 6B, and 10, the dab needle channel 241 may be located along a side of the multifunction lighter case 201. In further embodiments, such as with reference to FIG. 6C, the dab needle channel 241 may extend through the main body 210 of the multifunction lighter case 201 and into the curved cutaway portion 212 of the multifunction lighter case 201 so that when the dab needle 242 is stowed in the dab needle channel 241, the cutting tip 245 of the dab needle 242 extends into the open area of the curved cutaway portion 212. In this manner, a smoking article, for instance, a cigar may be inserted into the curved cutaway portion 212 and the cutting tip 245 may cut a portion of the smoking article, such as to remove the tip to prepare the article for lighting, or such as to slice open axially along the length of the smoking article, such as to replace the contents of the smoking article, such as to remove tobacco from a cigar and replace the tobacco with another substance desired to be smoked.

Figure 7A:
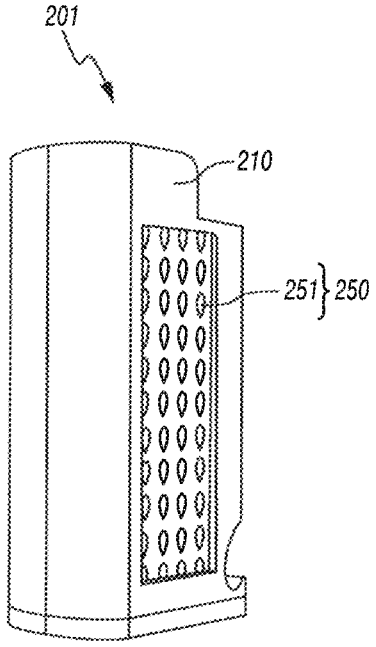
FIGS. 7A-B illustrate views of an example grinding apparatus of a multifunction lighter case, according to various embodiments.
Figure 7B:
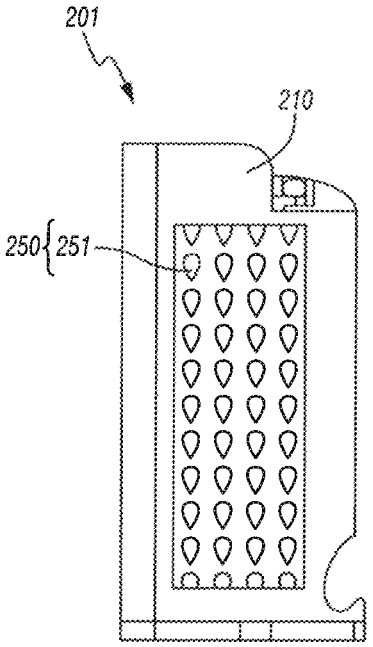
Figure 10:
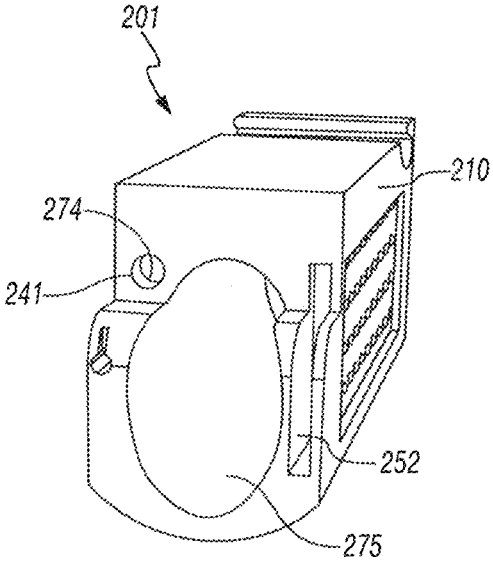
FIG. 10 illustrates a top view of an example multifunction lighter case, according to various embodiments.

With reference to FIGS. 7A-B and 10, in various embodiments, the multifunction lighter case 201 may further comprise a grinding apparatus 250. A grinding apparatus 250 may comprise an integrally formed surface and/or portion of the main body 210. For instance, the grinding apparatus 250 may comprise an integrally formed portion of a main body 210. In further embodiments, the grinding apparatus 250 may comprise a separately formed insert of the main body 210. For instance, the grinding apparatus 250 may comprise an insert shaped to fit a corresponding aperture of a main body 210.

The grinding apparatus 250 may grind a smoking material. For instance, a user may place a smoking material against the grinding apparatus 20 and at least one of, move, press, slide, and/or otherwise contact the smoking material against the grinding apparatus 250, mechanically separating the smoking material and/or otherwise preparing the smoking material such as for ignition, heating, and/or the like. The grinding apparatus 250 may comprise a set of apertures. The apertures may be disposed through a portion of the multifunction lighter case 201. As the smoking material is manipulated against the apertures, the smoking material may disaggregate and collect on the opposite side of the apertures, such as within a ground material cavity 252 (see FIG. 10).

For example, a grinding apparatus 250 may comprise a first aperture set 251. The first aperture set 251 may be defined through the main body 210. Smoking material may be manipulated against the apertures causing the smoking material to disaggregate and collect inside the main body 210.

Figure 8A:
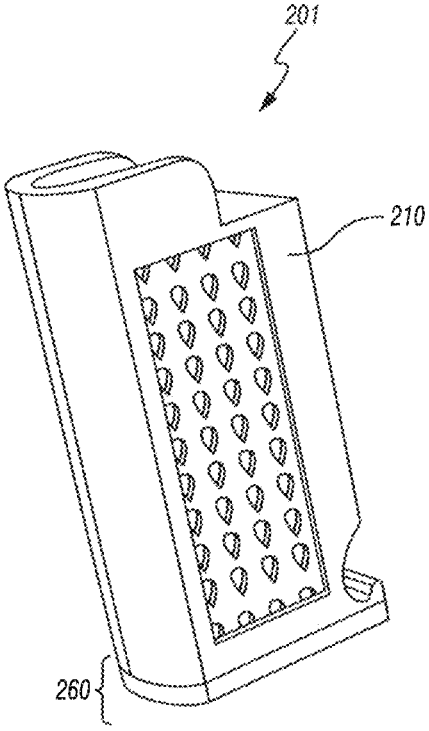
FIGS. 8A-B illustrate views of an example material piling mechanism of a multifunction lighter case, according to various embodiments.
Figure 8B:
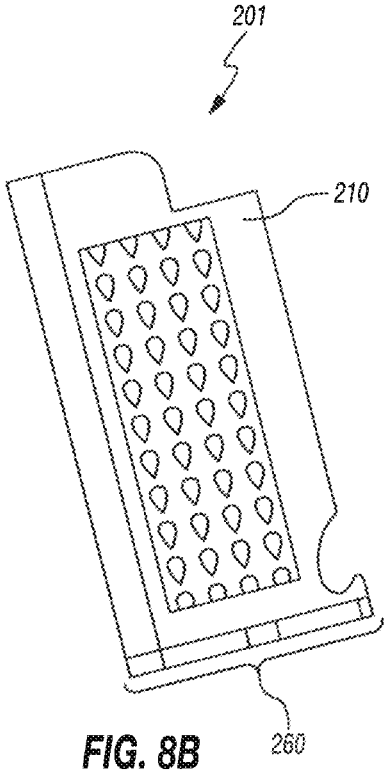

With reference to FIGS. 8A-B, in various embodiments, the multifunction lighter case 201 may comprise a material piling mechanism 260. A material piling mechanism 260 may comprise a scoop, a pan, a planar face, and/or any other structure whereby smoking material and/or other material that has been deposited on a surface may be piled, scooped, or otherwise spread and/or distributed as desired. For instance, a material piling mechanism 260 may comprise a planar face of the multifunction lighter case 201, which may be implemented to rake smoking material into a pile as desired.

Figure 9A:
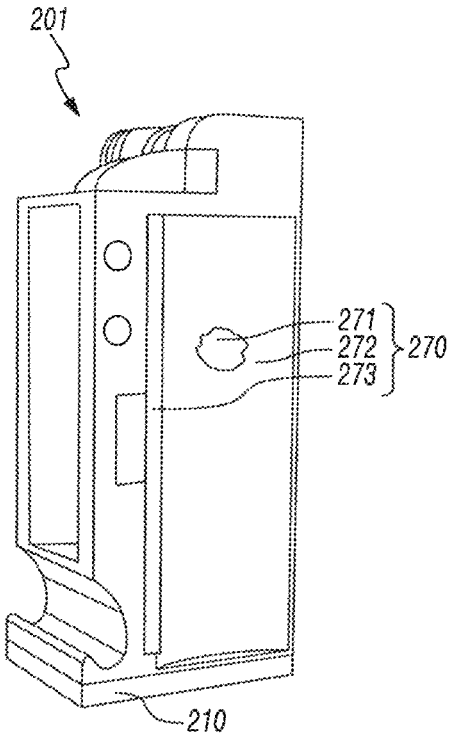
FIGS. 9A-B illustrate views of an example rolling paper dispenser of a multifunction lighter case, according to various embodiments.
Figure 9B:
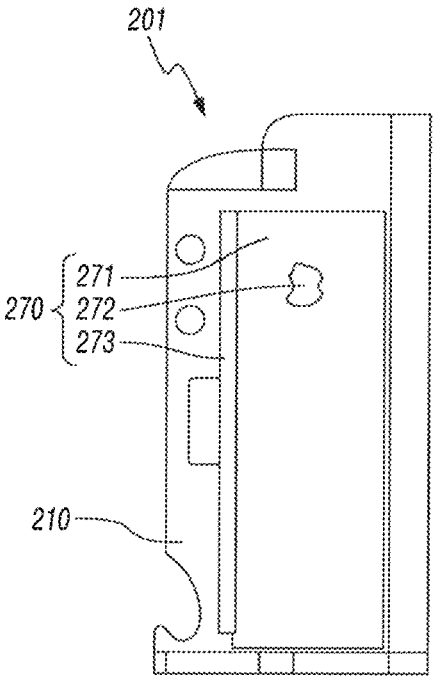

With reference to FIGS. 9A-B, in various embodiments, the multifunction lighter case 201 may comprise a rolling paper dispenser 270. A rolling paper dispenser 270 may comprise a dispensing feature whereby rolling papers may be stored, and then may be dispensed one-at-a-time as desired. For instance, the rolling paper dispenser 270 may comprise a rolling paper storage area 271 and a rolling paper door 272. The papers may be stored in the rolling paper storage area 271, and the rolling paper door 272 may be closed over the stored papers, leaving a dispensing gap 273 open, through which the papers may be drawn individually by a user.

With reference to FIG. 10, a lighter storage cavity 275 may be disposed through the multifunction lighter case 201. In various embodiments, the lighter storage cavity 275 is separated from the ground material cavity 252 and the dab needle channel 241. In various embodiments, various of the cavities and channels are in fluidic communication, such as by via holes 274, for instance, to facilitate cleaning, washing, and drying.

Figure 11A:
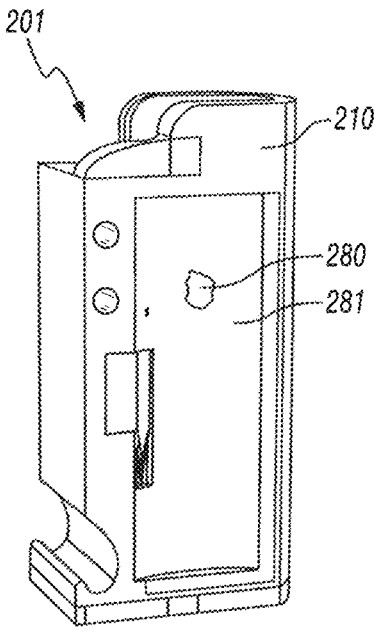
FIGS. 11A-B illustrate views of an example unused smoking material storage compartment of a multifunction lighter case, according to various embodiments.
Figure 11B:
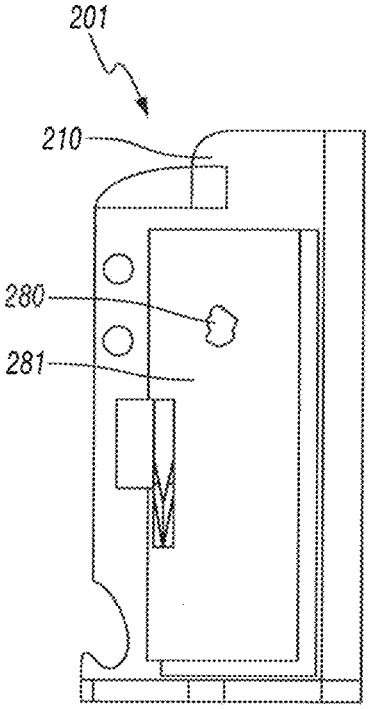

With reference to FIG. 11A-B, the multifunction lighter case 201 may comprise an unused smoking material storage compartment 280. In various embodiments, material desired to be smoked is stored in the unused smoking material storage compartment 280 pending smoking. The unused smoking material storage compartment 280 and the rolling paper dispenser 270 (FIGS. 9A-B) may occupy same and/or similar compartments. For instance, a rolling paper dispenser 270 (FIGS. 9A-B) may comprise a rolling paper storage area 271 (FIGS. 9A-B) at the same location as the unused smoking material storage compartment 280. However, the unused smoking material storage compartment 280 may be associated with a door 281 that may be closed over the stored smoking material that does not leave a dispensing gap open (so that the smoking material does not inadvertently escape the compartment).

Figure 12A:
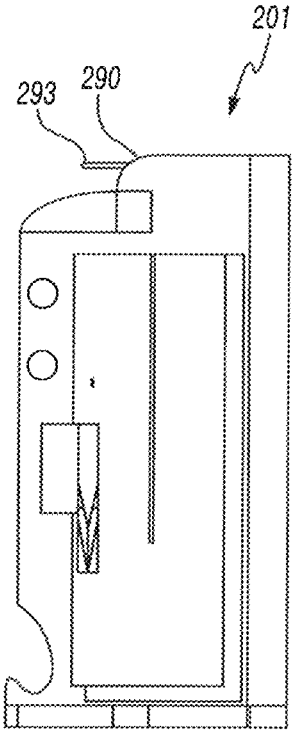
FIGS. 12A-B illustrate views of an example lighter wick dispenser of a multifunction lighter case, according to various embodiments.
Figure 12B:
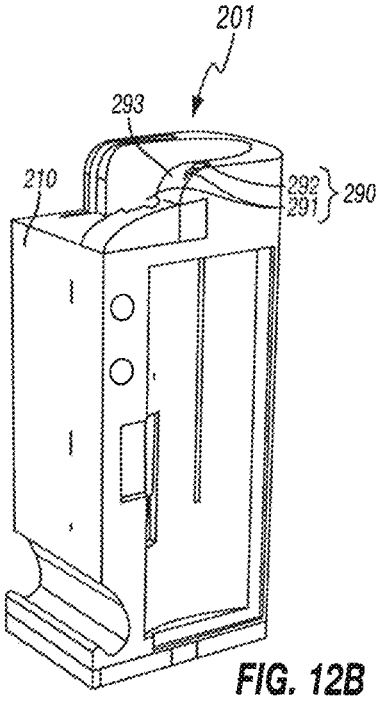
Figure 13:
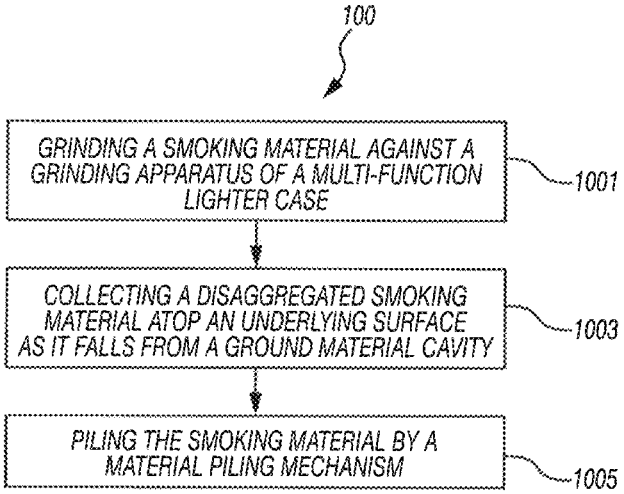
FIG. 13 illustrates a method of smoking material preparation according to various embodiments of a multifunction lighter case.
Figure 14:
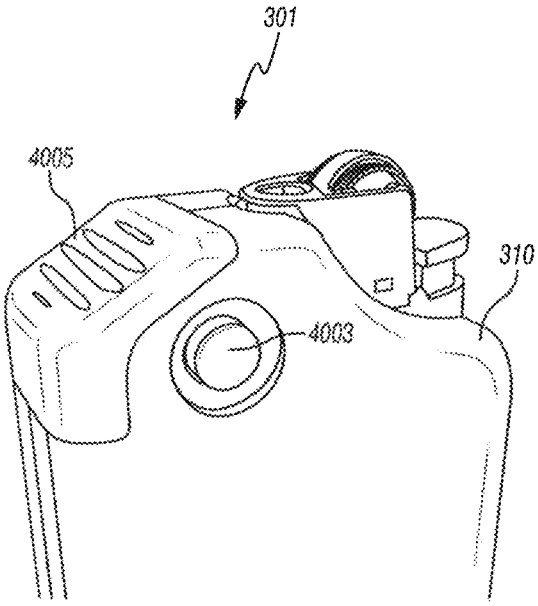
FIG. 14 illustrates a view of an example multifunction lighter case depicting a finger grip and piston latch button, according to various embodiments.
Figure 15:
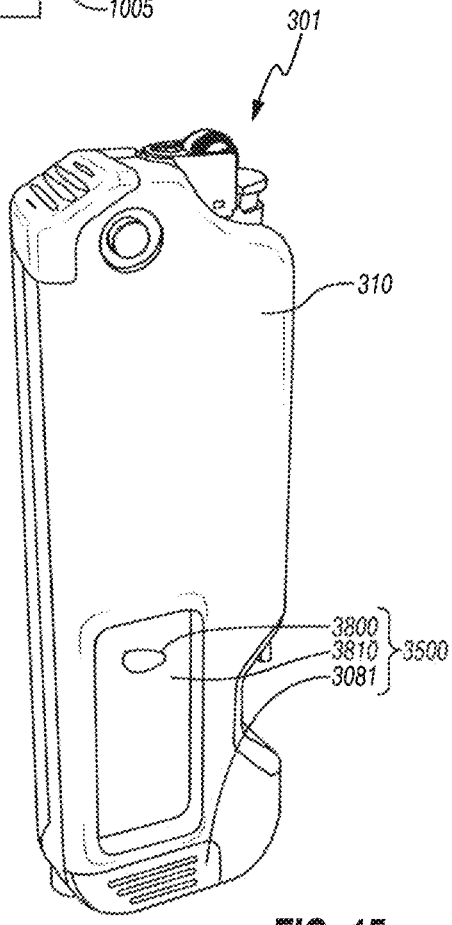
FIG. 15 illustrates a view of an example multifunction lighter case depicting a grinding apparatus, according to various embodiments.
Figure 16:
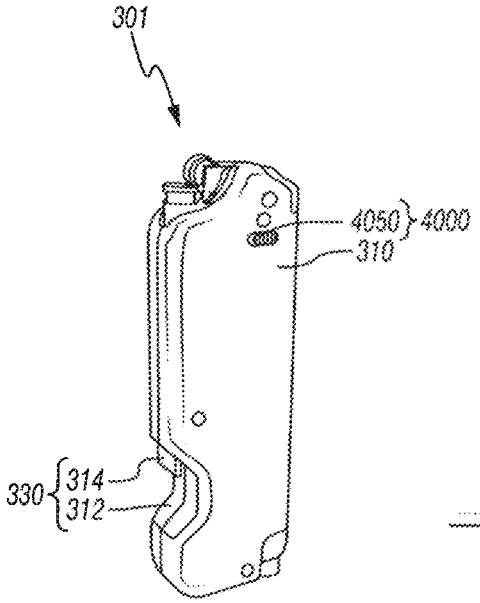
FIG. 16 illustrates a view of an example multifunction lighter case depicting various aspects of piston dispensing system and a bottle opener, according to various embodiments.
Figure 17:
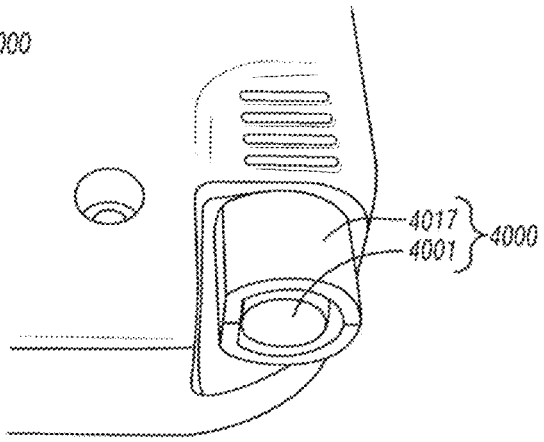
FIG. 17 illustrates a view of an example multifunction lighter case depicting various aspects of piston dispensing system, according to various embodiments.
Figure 18:
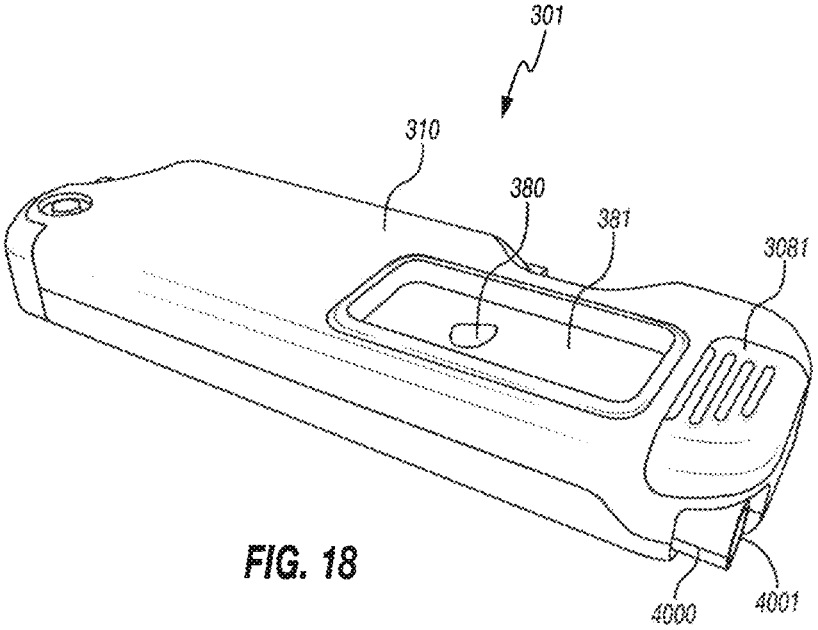
FIG. 18 illustrates a view of an example multifunction lighter case depicting various aspects of piston dispensing system ground smoking material storage compartment, grippable member, and other features, according to various embodiments.
Figure 19:
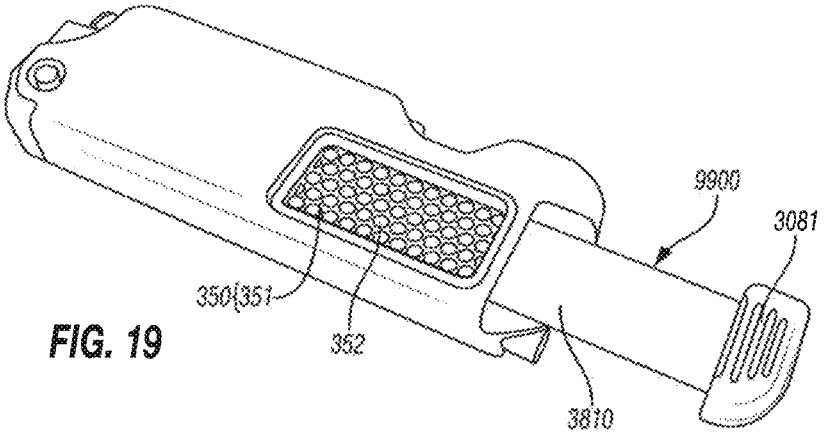
FIG. 19 illustrates a view of an example multifunction lighter case depicting various aspects of a grinding apparatus and grippable member, according to various embodiments.
Figure 20:
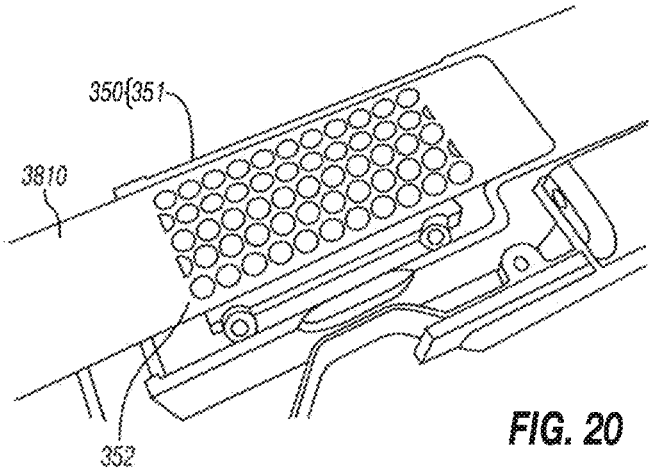
FIG. 20 illustrates a view of an example multifunction lighter case with a side removed and depicting various aspects of a grinding apparatus, according to various embodiments.
Figure 21:
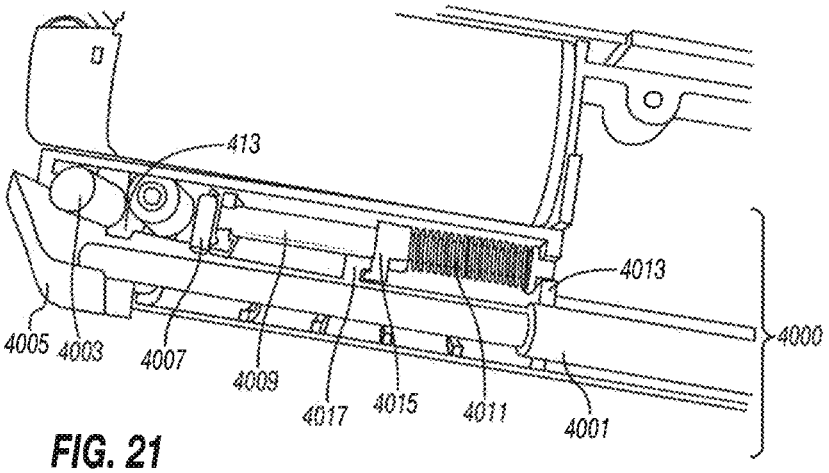
FIGS. 21-24 illustrate views of an example multifunction lighter case depicting various internal components of a piston dispensing system oriented in various positions, according to various embodiments.
Figure 22:
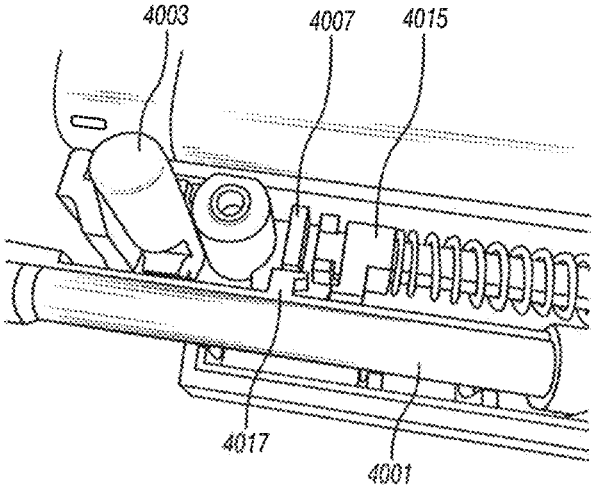
Figure 23:
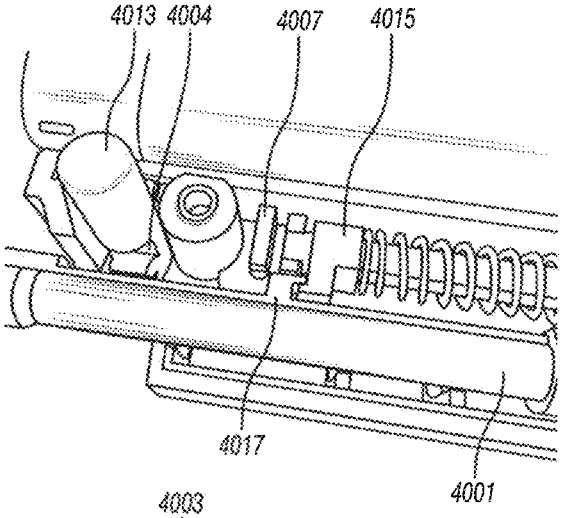
Figure 24:
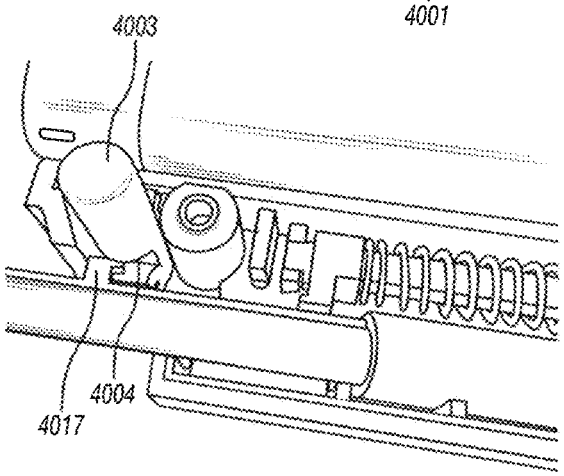
Figure 25:
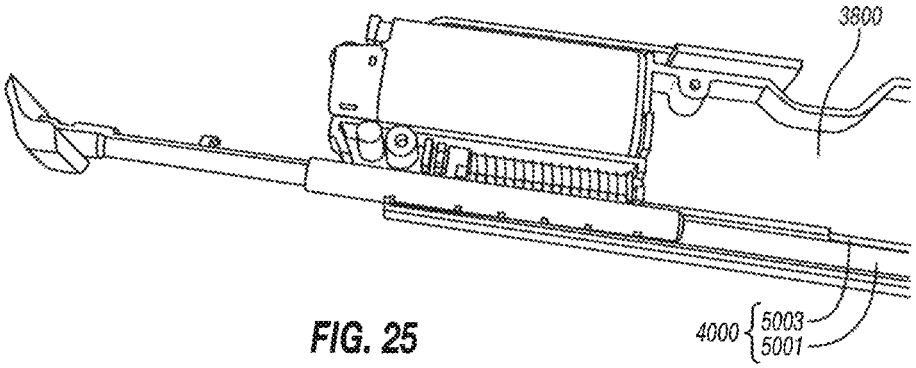
FIG. 25 illustrates a view of an example multifunction lighter case with a ground smoking material storage compartment, according to various embodiments.
Figure 26:
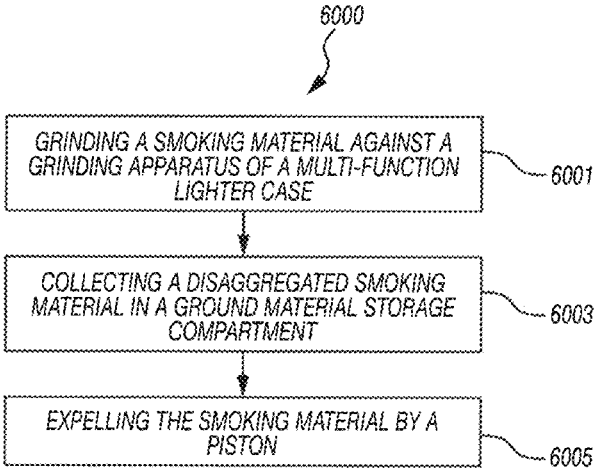
FIG. 26 illustrates a method of smoking material preparation according to various embodiments of a multifunction lighter case with a piston.

With reference to FIG. 12A-B and FIG. 10, the multifunction lighter case 201 may comprise a lighter wick dispenser 290. A lighter wick dispenser 290 may comprise an aperture disposed through a surface of the multifunction lighter case 201 through which a stored wick 293 may be drawn. The lighter wick dispenser 290 may comprise a retention slot 291 and a dispenser aperture 292. For instance, the wick 293 may be frictionally engaged within a retention slot 291, such as for storage, and then may be drawn through the dispenser aperture 292 such as to increase the amount of wick 293 exposed. In various embodiments, wick 293 comprises a wick made of plant matter, although any material as desired may be implemented.

With reference now to FIGS. 14-25, a multifunction lighter case 301 may comprise a case configured to receive a portable lighter and also including a piston assembly. The multifunction lighter case 301 may form a partial enclosure about the lighter wherein the lighter may be disposed at least partially inside the main body of the multifunction lighter case. In this manner, the multifunction lighter case 301 may provide protection to the lighter and may be conveniently co-located with the lighter, such as for carrying and storage. In various embodiments, the multifunction lighter case 301 may comprise a main body 310. The main body 310 may comprise a unitary body structure of the multifunction lighter case 301. The main body 310 may comprise a one-piece structure with various features, apertures, and the like, and may be configured to receive a lighter disposed at least partially inside the main body 310. Thus, one may appreciate that while a main body 10 (FIGS. 1A-2C) may be selectably openable about a hinge, a main body 310 may comprise a one-piece body that receives a lighter therein. In further embodiments, various features of various embodiments disclosed herein, such as features of main body 10 and main body 210 and main body 310 or more generally, features of multifunction lighter case 201, multifunction lighter case 301, and clamshell multifunction lighter case 1 may be mixed and/or combined (for example, ash bowl 218).

In various embodiments, the multifunction lighter case 301 may comprise a bottle opener 330. For instance, a bottle opener 330 may comprise a curved cutaway portion 312 of a multifunction lighter case 301 disposed in a side of the multifunction lighter case 301 and configured to receive a crimp-top of a bottle and permit the crimp-top to be removed from the bottle, such as by a lever motion wherein the multifunction lighter case 301 is arcuately articulated about a fulcrum provided by at least one of the bottle and the crimp-top. The bottle opener 330 may further comprise a sharp edge 314 engagable with the crimp-top. In various embodiments, as discussed further herein, sharp edge 314 and curved cutaway portion 312 may perform other functions as well.

The multifunction lighter case 301 may comprise a ground smoking material storage compartment 3800, which may be combinable with a grinding apparatus 3500 as a component thereof. Furthermore, a grinding apparatus 350 and specifically, the ground smoking material storage compartment 3800 may have multiple functions, such as to provide a compartment to store ground smoking material, or unused smoking material, or rolling papers, or lighter wick, and/or the like. Moreover, the various separately distinctive cavities or compartments discussed elsewhere herein may be combined with aspects of the multifunction lighter case 301 to create further combinations.

In various embodiments, the multifunction lighter case 301 may further comprise a grinding apparatus 3500. A grinding apparatus 3500 may comprise an slidable insert, insertable into a portion of the main body 310. For instance, the grinding apparatus 350 may comprise a slidable sheet comprising a blocking portion 3810 slidable over an opening of an ground smoking material storage compartment 3800. In this manner, a user may manipulate a grippable member 3081 of the grinding apparatus 350, whereby the slidable sheet comprising a blocking portion 3810 may be moved so that the blocking portion 3810 occludes the opening of the ground smoking material storage compartment 3800. The user may further manipulate the grippable member 3081 to slide the slidable sheet comprising a blocking portion 3810 so that the blocking portion does not occlude the opening of the ground smoking material storage compartment 3800. By such sliding or other manipulation, a different portion of the slidable sheet comprising a grinding apparatus 350 may be slidably oriented over the opening of the ground smoking material storage compartment 3800. For instance, a portion comprising a set of apertures and the blocking portion may be alternately slidable into orientation over the opening of the ground smoking material storage compartment.

The grinding apparatus 350 may grind a smoking material. For instance, a user may place a smoking material against the grinding apparatus 350 and at least one of, move, press, slide, and/or otherwise contact the smoking material against the grinding apparatus 350, mechanically separating the smoking material and/or otherwise preparing the smoking material such as for ignition, heating, and/or the like. The grinding apparatus 350 may comprise a set of apertures. The apertures may be disposed through a portion of the multifunction lighter case 301. As the smoking material is manipulated against the apertures, the smoking material may disaggregate and collect on the opposite side of the apertures, such as within a ground material cavity 352.

For example, a grinding apparatus 350 may comprise a first aperture set 351. The first aperture set 351 may be defined through the main body 310. In further embodiments, the first aperture set 351 is defined through the slidable sheet and is adjacent the blocking portion 3810 along the length of the slidable sheet 9900 so that the blocking portion 3810 and the first aperture set 351 are alternately positionable in alignment with the opening of the ground smoking material storage compartment. Smoking material may be manipulated against the apertures causing the smoking material to disaggregate and collect inside the main body 310.

In various embodiments, a multifunction lighter case 301 may comprise a piston dispensing system 4000. The piston dispensing system may comprise an transfer aperture 5003 connecting the ground smoking material storage compartment 3800 to a piston channel 5001. A piston 4001 may slidably reciprocate within the piston channel 5001 in response to manipulation by a user so that it alternately occupies and vacates a portion of the piston channel coincident with the transfer channel 5001. The piston 4001 may be slidably removed from a portion of the piston channel 5001 coincident with the transfer aperture 5003, allowing ground smoking material to enter the piston channel 5001. The piston 4001 may subsequently be slidably inserted into the same portion of the piston channel 5001 and may be pressed against the ground smoking material, compressing it, and expelling it from an extrusion orifice 4017 disposed at a distal end of the piston channel. A user may place a receptacle such as a rolling paper against the extrusion orifice 4017 so that the compacted smoking material is expelled directly into the rolling paper.

The piston dispensing system 4000 may comprise various additional features. For example, a spring 4011 may be wrapped around a spring guide 4009 and react a spring force against a spring platform 4013, pressing a spring loaded transfer clip 4015 against a reciprocal piston clip 4017 formed in the piston 4001 so that the piston 4001 may be more readily slidably removed form a portion of the piston channel 5001 by a user grasping a finger grip 4005. For instance, a user may press a piston latch button 4003, configured to permit a latch channel 4004 to align with an aspect of the piston 4001 so that the piston may be slidable within the piston channel 5001, but not entirely liberated from the piston channel 5001. Alternately, the user may unlatch a piston lock 4050, sliding a piston lock bar 4007 away from the piston 4001, and away from the reciprocal piston clip 4017, permitting the piston to be entirely liberated from the device, such as upon releasing of the piston latch button 4003 configured to permit the piston to slide within the piston channel 5001.

The piston 4001 within the unit 301 extends and retracts as discussed. A user may repetitively push on the piston 4001, such as on a finger grip 4005 to dispense the desired quantity of smoking material. After use, the user can lock the piston 4001 into its position to close the extrusion orifice 4017.

Figure 27:
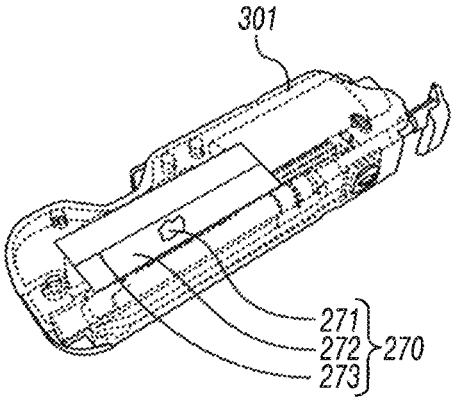
FIG. 27 illustrates a view of an example multifunction lighter case depicting a storage compartment for rolling papers with dispensing slot, according to various embodiments.

With reference now to FIG. 27, an example multifunction lighter case 301 may comprise a rolling paper dispenser 270. A rolling paper dispenser 270 may comprise a dispensing feature whereby rolling papers may be stored, and then may be dispensed one-at-a-time as desired. For instance, the rolling paper dispenser 270 may comprise a rolling paper storage area 271 and a rolling paper door 272. The papers may be stored in the rolling paper storage area 271, and the rolling paper door 272 may be closed over the stored papers, leaving a dispensing gap 273 open, through which the papers may be drawn individually by a user.

Figure 28:
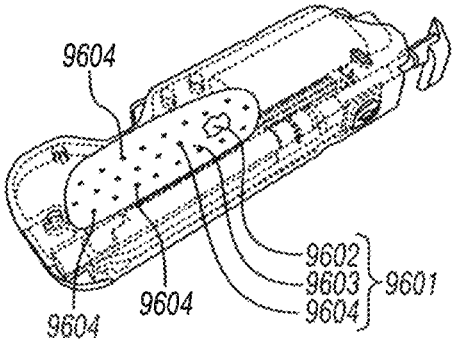
FIG. 28 illustrates a view of an example multifunction lighter case depicting a kief collector, according to various embodiments.

With reference now to FIG. 28, an example multifunction lighter case 301 may comprise a kief collector 9601. Keif is a powder made from dried resin glands, for example, trichomes, that are found on the leaves of an herb plant. A kief collector 9601 may comprise a collecting feature whereby kief may be collected and stored. For instance, the kief collector 9601 may comprise a kief storage area 9602 enclosed by a kief storage door 9603 having a plurality of holes 9604. The kief may be collected by grinding of the herb against the plurality of holes 9604.

Figure 29:
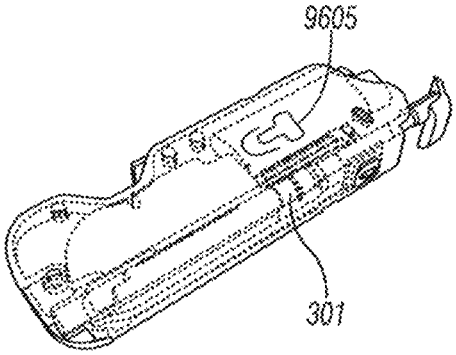
FIGS. 29-30 illustrates views of an example multifunction lighter case with a clamp, according to various embodiments.
Figure 30:
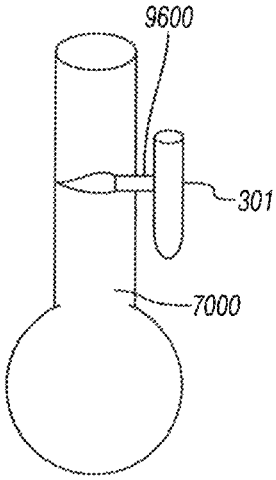

With reference now to FIGS. 29-30, an example multifunction lighter case 301 may comprise a clamp 9605. A clamp 9605 may be configured to selectable join to another device, such as a water pipe 7000. This may facilitate ready storage of the multifunction lighter case 301.

Figure 31:
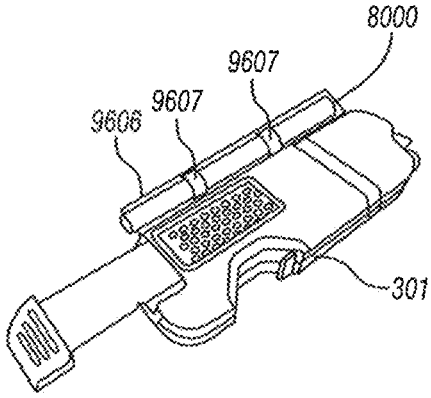
FIG. 31 illustrates a view of an example multifunction lighter case depicting a pipe attachment, according to various embodiments.

With reference now to FIG. 31, an example multifunction lighter case 301 may comprise a pipe storage fixture 9606 forming a cavity to receive another item, such as a pipe 8000. The pipe storage fixture 9606 may be aligned parallel to a primary longitudinal axis of the multifunction lighter case 301. In various embodiments, the pipe storage fixture 9606 is connectable to the multifunction lighter case 301 by a mounting member 9607. A mounting member 9607 may comprise a structure extending laterally away (approximately perpendicular to the primary longitudinal axis) the multifunction lighter case 301 and adjoining the multifunction lighter case 301 in selectable or permanent fixity to the pipe storage fixture 9606.

Figure 32:
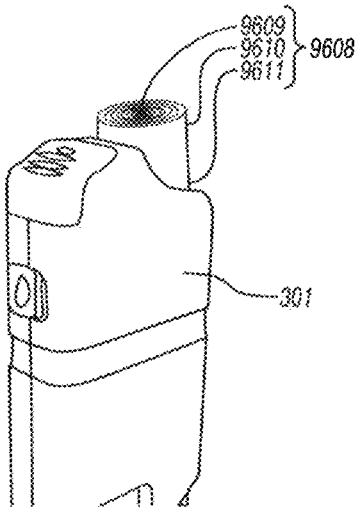
FIG. 32 illustrates a view of an example multifunction lighter case depicting an electric lighter, according to various embodiments.

With reference now to FIG. 32, an example multifunction lighter case 301 may comprise an electric lighter 9608. An electric lighter may comprise a heatable coil 9609. A heatable coil 9609 may comprise a selectably warmable member, such as a coil of wire, that may be caused to heat, such as in response to an electric current. The electric lighter 9606 may also comprise an on/off switch 9610 configured to selectably connect a power source 9611, such as a battery, to the heatable coil 9609.

Figure 33:
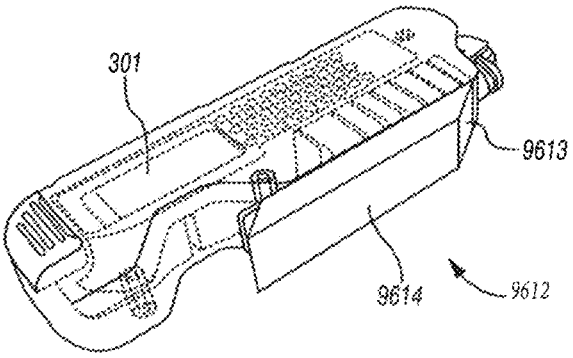
FIG. 33 illustrates a view of an example multifunction lighter case depicting an extended storage compartment, according to various embodiments.

With reference now to FIG. 33, an example multifunction lighter case 301 may comprise an external storage compartment 9612. For instance, a structure defining a cavity may be joined to the multifunction lighter case 301. For instance, an external storage compartment 9612 may include a longitudinally extending enclosed compartment 9614 having an openable door 9613 to permit access to items disposed inside the longitudinally extending enclosed compartment 9614.

Figure 34:
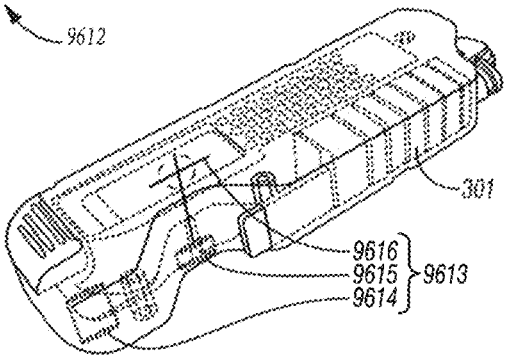
FIG. 34 illustrates a view of an example multifunction lighter case depicting a herb blender, according to various embodiments.

With reference now to FIG. 34, an example multifunction lighter case 301 may comprise an herb blender 9613. An herb blender 9613 may blend a plurality of smoking materials together in advance of smoking. For instance, an herb blender 9613 may comprise a blending blade 9616 that is rotated by a motor 9615, the motor powered by a power source 9614, such as a battery.

Figure 35:
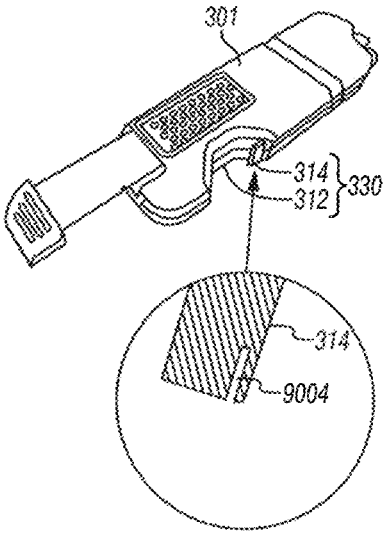
FIGS. 35-36 illustrate views of an example multifunction lighter case depicting a lighter safety remover, according to various embodiments.
Figure 36:
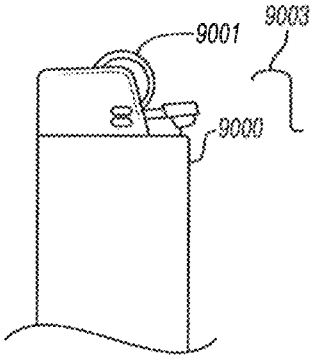

With reference now to FIGS. 35-36, an example multifunction lighter case 301 may comprise a lighter safety remover 9004. A groove 9004 may be disposed into the sharp edge 314 of the bottle opener 330. For instance, a groove may defined into and bounded by the sharp edge 314 so that it penetrates through a shorter face of the sharp edge 314, and thus may be said to be disposed longitudinally into the sharp edge 314 of the bottle opener 330. Thus an attached lighter safety 9001 of a lighter 9000 may be positioned in the curved cutaway portion 312 and articulated so that the groove 9004 lifts the attached lighter safety 9001 away from the lighter 9000 so that it becomes a removed lighter safety 9003.

Figure 37:
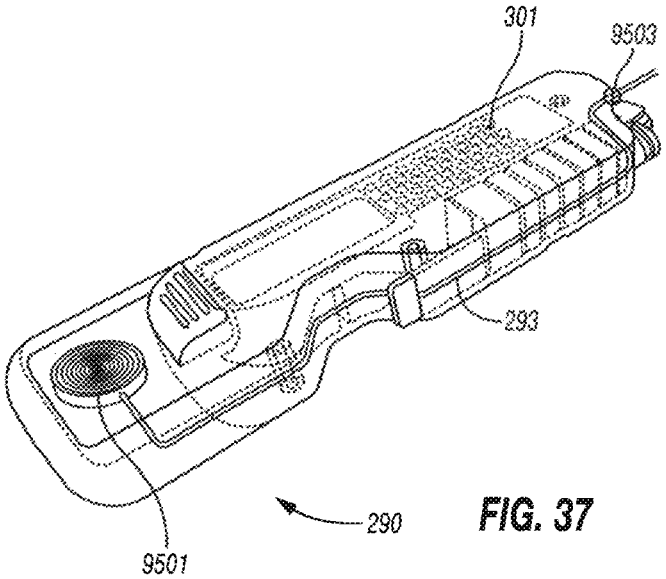
FIG. 37 illustrates a view of an example multifunction lighter case depicting a wick reel dispenser, according to various embodiments.

With reference to FIG. 37, the multifunction lighter case 301 may comprise a lighter wick dispenser 290. A lighter wick dispenser 290 may comprise an aperture 9503 disposed through and bounded by a surface of the multifunction lighter case 301 through which a wick 293 may be drawn. The lighter wick dispenser 290 may comprise a wick reel 9501 comprising a rotatable cylinder on which the wick 293 may be stored, and then may be drawn through the dispenser aperture 9503 such as to increase the amount of wick 293 exposed. In various embodiments, wick 293 comprises a wick made of plant matter, although any material as desired may be implemented.

Figure 38:
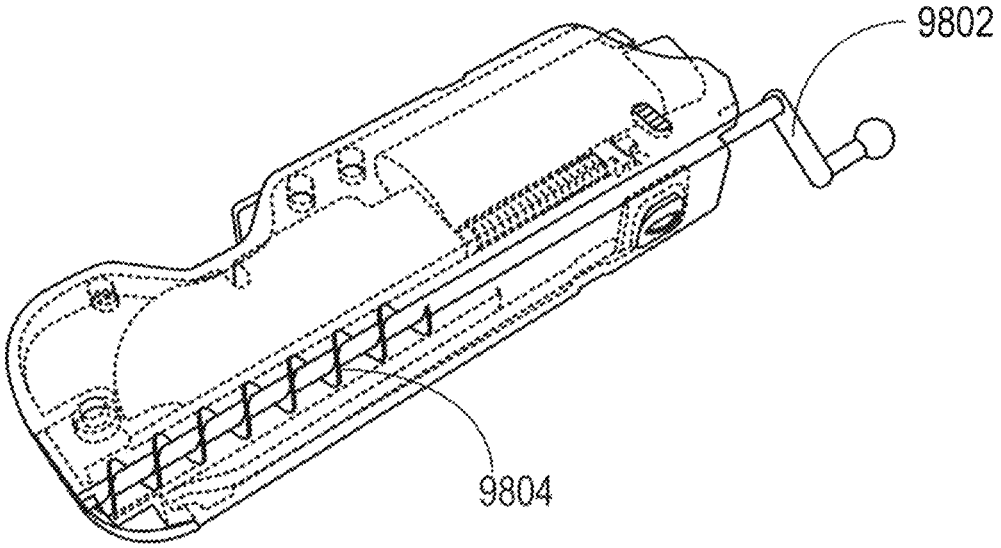
FIG. 38 illustrates a view of an example multifunction lighter case depicting a dispensing auger, according to various embodiments.

Finally, with reference to FIG. 38, the multifunction lighter case 301 may comprise a dispensing auger 9804 that is operated by turning a dispensing crank 9802. A dispensing auger 9804 may transfer disaggregated smoking material from an internal storage area to an opening, so that the material may be stored in the multifunction lighter case 301 and may be dispensed in metered amounts as a user desires.

Having discussed various structural aspects of lighter cases, methods of using lighter cases are presented. With reference to FIGS. 1A-B, 2A-C, and 3A, a smoking material preparation method 100 may comprise grinding a smoking material against a grinding apparatus 20 of a clamshell multifunction lighter case 1, wherein the clamshell multifunction lighter case 1 is configured in an open configuration (Step 101). The method may include collecting a disaggregated smoking material atop an underlying surface (Step 103). The method may include closing the clamshell multifunction lighter case 1, wherein the scooping apparatus 60 scoops the disaggregated smoking material from the underlying surface into the internal area 70 of the clamshell multifunction lighter case 1 (Step 105). Subsequently, the ramp member 30 may guide the disaggregated smoking material into a receptacle, such as a bowl, pipe, and/or the like (Step 107).

With reference to FIGS. 1A-B, 2A-C, and 3B, a smoking material preparation method 150 may comprise grinding a smoking material against a grinding apparatus 20 of a clamshell multifunction lighter case 1, wherein the clamshell multifunction lighter case 1 is configured in a closed configuration (Step 151). The method may include collecting a disaggregated smoking material in the internal area 70 of the clamshell multifunction lighter case 1 (Step 153). Subsequently, the ramp member 30 may guide the disaggregated smoking material into a receptacle, such as a bowl, pipe, and/or the like (Step 155).

With reference to FIGS. 4A-12B and 13, a smoking material preparation method 1000 may comprise grinding a smoking material against a grinding apparatus 220 of a multifunction lighter case 201 (Step 1001). The method may include collecting a disaggregated smoking material atop an underlying surface as it falls from a ground material cavity 252 (Step 1003). The method may include piling the smoking material by a material piling mechanism 260 (Step 1005).

With reference to FIGS. 14-25, and 26, a smoking material preparation method 6000 may comprise grinding a smoking material against a grinding apparatus of a multifunction lighter case (Step 6001). The method may include collecting a disaggregated smoking material in a ground smoking material storage compartment (Step 6003). The method may include expelling the smoking material by a piston (Step 6005).

Now, having described various components of various exemplary embodiments of a lighter case, the lighter case may be manufactured from various materials. In various embodiments, the lighter case comprises polyvinyl chloride ("PVC"). The lighter case may further comprise thermoplastic aliphatic polyester, such as polylactide ("PLA"), or may comprise other thermoplastics, such as acrylonitrile butadiene styrene ("ABS") plastic, or may comprise any plastic. In some embodiments, the lighter case comprises ultraviolet light ("UV") resistant materials, including, for example, one or more plastics comprising a UV stabilizer to protect the system from long-term UV degradation.

In further exemplary embodiments, the lighter case may comprise metal, plastic, or a combination thereof. For example, the lighter case may comprise metal, such as aluminum. Alternatively, the lighter case may comprise metal, such as titanium, steel, stainless steel, or galvanized material, though it may alternatively comprise numerous other materials configured to provide support, such as, for example, fiberglass, composite, ceramic, ceramic matrix composite, plastics, polymers, alloys, austenitic nickel-chromium-based alloys, glass, binder, epoxy, polyester, acrylic or any material or combination of materials having a desired strength, stiffness, density, weight, or flexibility sufficient to maintain resiliency during use.

In various embodiments, various portions of the lighter case as disclosed herein are made of different materials or combinations of materials, and/or may comprise coatings, including plastics, silicones, and latex. For instance, the grinding apparatus may comprise materials having different material properties, such as sharpened metals and/or the like. Any material or material combination suitable to enhance or reinforce the resiliency and/or support of the lighter case when subjected to wear in an operating environment or to satisfy other desired weight, size, cost, chemical, physical, or biological properties, for example nonreactivity, durability, UV resistance, light weight, load capacity, and heat tolerance may be implemented. For example, various components may comprise metal while other components may comprise plastics and/or rubber.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. The scope of the inventions is accordingly to be limited by nothing other than the appended claims, in which reference to an element in the singular is not intended to mean "one and only one" unless explicitly so stated, but rather "one or more."

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A multifunction lighter case comprising:

a main body comprising a unitary body structure forming a partial enclosure configured to receive a lighter at least partially inside the main body of the multifunction lighter case;

a grinding apparatus comprising an integral surface of a slidable sheet, wherein the grinding apparatus is configured to disaggregate a smoking material;

a bottle opener, the bottle opener comprising:

a curved cutaway portion disposed in a side of the main body of the multifunction lighter case and configured to receive a crimp-top of a bottle, and a sharp edge engagable with the crimp top and configured to permit a user to remove the crimp-top in response to an arcuate articulation of the multifunction lighter case;

a ground smoking material storage compartment configured to receive the ground smoking material from the grinding apparatus, wherein the grinding apparatus comprises the slidable sheet and the slidable sheet is insertable into a portion of the main body, wherein the slidable sheet comprises:

a blocking portion slidable over an opening of the ground smoking material storage compartment, and a first aperture set defined through the slidable sheet and adjacent the blocking portion, wherein the first aperture set and the blocking portion is each alternately slidable over the opening of the ground smoking material storage compartment; and a piston dispensing system, the piston dispensing system comprising:

a transfer aperture connecting a ground smoking material storage compartment to a piston channel, a piston configured to slidably reciprocate within the piston channel and alternately occupy and vacate a portion of the piston channel coincident with the transfer channel, an extrusion orifice disposed at a distal end of the piston channel and configured to receive a compressed smoking material compressed by the piston and expel the compressed smoking material, a spring wrapped around a spring guide and configured to react a spring force against a spring platform, a reciprocal piston clip formed in the piston, a spring loaded transfer clip pressed by the spring against the reciprocal piston clip formed in the piston, a piston latch button configured to permit a latch channel to align so that the piston is reciprocally slidable within the piston channel, and a piston lock comprising a piston lock bar slidable away from the piston and away from the reciprocal piston clip, whereby the piston is removable from the piston channel.

* * * * *